US011105548B2

(12) United States Patent
Rieder

(10) Patent No.: US 11,105,548 B2
(45) Date of Patent: Aug. 31, 2021

(54) NUCLEATION NOZZLE AND METHOD FOR FORMING FREEZING NUCLEI

(71) Applicant: TECHNOALPIN HOLDING S.P.A., Bolzano (IT)

(72) Inventor: Walter Rieder, Bolzano (IT)

(73) Assignee: TECHNOALPIN HOLDING S.P.A., Bolzano (IT)

( * ) Notice: Subject to any disclaimer, the term of this patent is extended or adjusted under 35 U.S.C. 154(b) by 528 days.

(21) Appl. No.: 16/077,959

(22) PCT Filed: Feb. 10, 2017

(86) PCT No.: PCT/IB2017/050746

§ 371 (c)(1),
(2) Date: Aug. 14, 2018

(87) PCT Pub. No.: WO2017/141144

PCT Pub. Date: Aug. 24, 2017

(65) Prior Publication Data

US 2021/0102739 A1 Apr. 8, 2021

(30) Foreign Application Priority Data

Feb. 15, 2016 (IT) ..... 102016000015257

(51) Int. Cl.

| | |
|---|---|
| ***F25C 3/04*** | (2006.01) |
| ***B05B 7/00*** | (2006.01) |
| ***B05B 7/08*** | (2006.01) |

(52) U.S. Cl.

CPC ..... *F25C 3/04* (2013.01); *B05B 7/0075* (2013.01); *B05B 7/0853* (2013.01); *F25C 2303/0481* (2013.01)

(58) Field of Classification Search

CPC ..... F25C 3/00; F25C 3/04; F25C 2303/00; F25C 2303/048; F25C 2303/0481;
(Continued)

(56) References Cited

U.S. PATENT DOCUMENTS 3,464,625 A * 9/1969 Carlsson ..... F04F 5/466 239/2.2

3,762,176 A 10/1973 Coggins (Continued)

FOREIGN PATENT DOCUMENTS

| | | |
|---|---|---|
| CA | 2 276 016 | 10/2000 |
| JP | H02 208471 | 8/1990 |
| WO | WO 2007/046566 | 4/2007 |

OTHER PUBLICATIONS

PCT/I132017/050746, Oct. 12, 2017, International Search Report and Written Opinion.

*Primary Examiner* — Darren W Gorman
(74) *Attorney, Agent, or Firm* — Workman Nydegger

(57) ABSTRACT

A nucleation nozzle for forming freezing nuclei for devices for making artificial snow, starting from a jet of pressurised liquid, comprising a compressed air duct having an inlet opening and an outlet opening. A first stretch of the compressed air duct has a cross section which decreases in the flow direction of the compressed air, from the inlet opening to the outlet opening. The first stretch is followed by a second stretch having a cross section which increases in the flow direction of the compressed air from the inlet opening to the outlet opening. There is provided at least one water duct having an inlet opening and an outlet opening. The water duct is separate from the compressed air duct. The outlet opening of the water duct is positioned close to the outlet opening of the compressed air duct.

13 Claims, 2 Drawing Sheets

Figure 1:
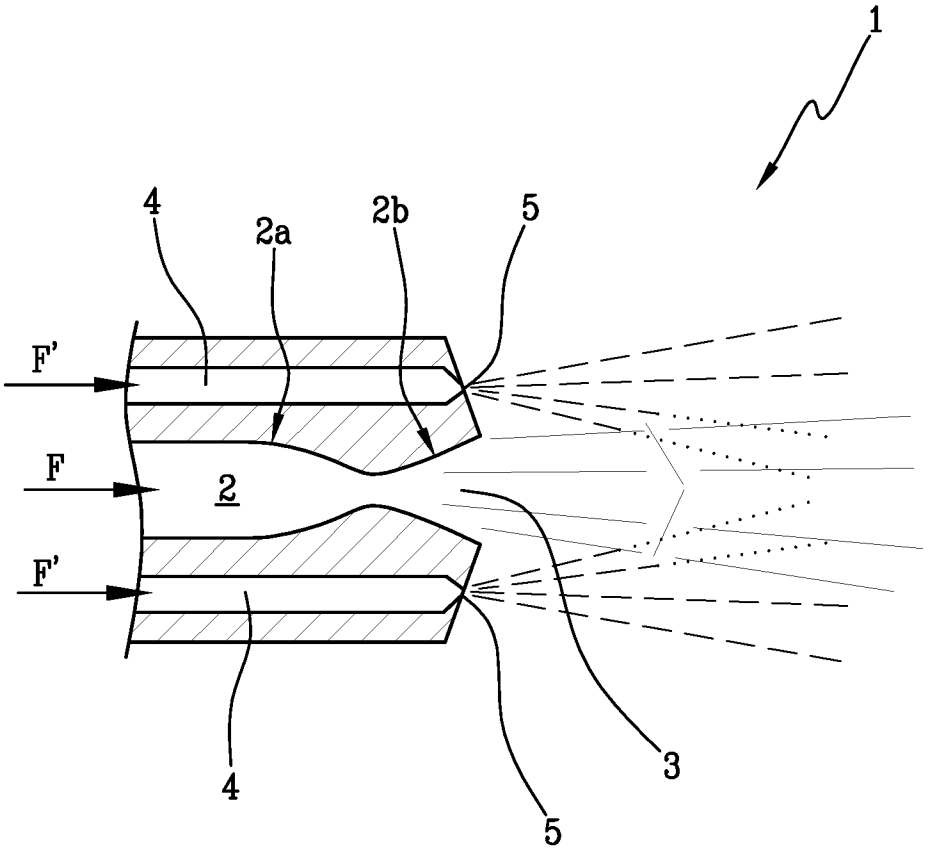

(58) Field of Classification Search
CPC ..... B05B 7/0075; B05B 7/065; B05B 7/0853; B05B 7/0892
See application file for complete search history.

(56) References Cited

U.S. PATENT DOCUMENTS

| | | | | | |
|---|---|---|---|---|---|
| 3,923,247 | A * | 12/1975 | White | F25C 3/04 | 239/14.2 |
| 4,145,000 | A * | 3/1979 | Smith | F04F 5/42 | 239/14.2 |
| 4,383,646 | A * | 5/1983 | Smith | B05B 1/14 | 239/14.2 |
| 4,493,457 | A | 1/1985 | Dilworth et al. | | |
| 4,793,554 | A | 12/1988 | Kraus et al. | | |
| 4,915,302 | A * | 4/1990 | Kraus | F25C 3/04 | 239/14.2 |
| 5,529,242 | A * | 6/1996 | Hedin | B05B 1/267 | 239/14.2 |
| 5,909,844 | A * | 6/1999 | Nilsson | F25C 3/04 | 239/14.2 |
| 2006/0071091 | A1* | 4/2006 | Ratnik | F25C 3/04 | 239/14.2 |
| 2011/0049258 | A1* | 3/2011 | Lehner | B05B 7/0853 | 239/2.2 |
| 2014/0291413 | A1* | 10/2014 | Dodson | F25C 3/04 | 239/14.2 |

* cited by examiner

NUCLEATION NOZZLE AND METHOD FOR FORMING FREEZING NUCLEI

The present invention relates to a nucleation nozzle for forming freezing nuclei for devices for making artificial snow.

The present invention further relates to a method for forming freezing nuclei.

In particular, the present invention is aimed at the field of nucleation nozzles used in devices for generating artificial snow, commonly known by the term "snow cannons" or "snow lances".

For the sake of simplicity, we will make reference hereinafter to the preferred embodiment, in which the apparatus is used for a snow cannon. In accordance with the prior art, a snow cannon comprises a tubular body having an inlet port and an outlet port. A passage area is defined inside the tubular body and is in fluid communication with the outside through the inlet port and the outlet port.

Furthermore, a blowing means is usually installed inside the tubular body to draw in air from the inlet port and generate an outflow of air from the outlet port.

In particular, the blowing means comprises a motor and a fan connected to the motor. Furthermore, the snow cannon comprises a plurality of nebulising nozzles positioned around the outlet port for the delivery of water.

In addition, the cannon comprises nucleation nozzles suitable for forming the freezing nuclei that constitute the germ on which the snowflake is constructed following the deposit of the liquid nebulised by the nebulising nozzles.

In general, compressed air and water flow into the nucleation nozzles in such a way that the particles (drops) of water that are expelled from the nucleation nozzles freeze immediately on being introduced into the outside environment as a result of expansion when exiting the nozzle.

Furthermore, the nebulised liquid particles (expelled from the nebulising nozzles) accumulate on the freezing nuclei to form snowflakes.

Examples of structures of such nucleation nozzles are known from the prior documents JPH02208471 and CA2276016.

Using the so-called Laval effect in nucleation nozzles is also known. An example of such an application is provided in document EP2071258.

This document envisages the joint acceleration of both the compressed air and the water particles.

However, such nozzles require a large energy input and in any case require rather rigid temperatures in order to function in an optimal manner. In this situation, the object of the present invention is to provide a nucleation nozzle and a method for forming freezing nuclei capable of remedying the aforementioned drawbacks.

In particular, it is an object of the present invention to provide a nucleation nozzle and a method for forming freezing nuclei which enable freezing nuclei to be produced while optimising energy resources and generating greater amounts of snow and which is of higher quality, i.e. finer.

It is a further object of the present invention to provide a nucleation nozzle and a method for forming freezing nuclei which enable snow to be generated at higher temperatures.

The specified objects are substantially achieved by a nucleation nozzle and a method for forming freezing nuclei as disclosed in the appended claims.

Additional features and the advantages of the present invention will become more apparent from the following detailed description of some preferred, but not exclusive embodiments.

Figure 2:
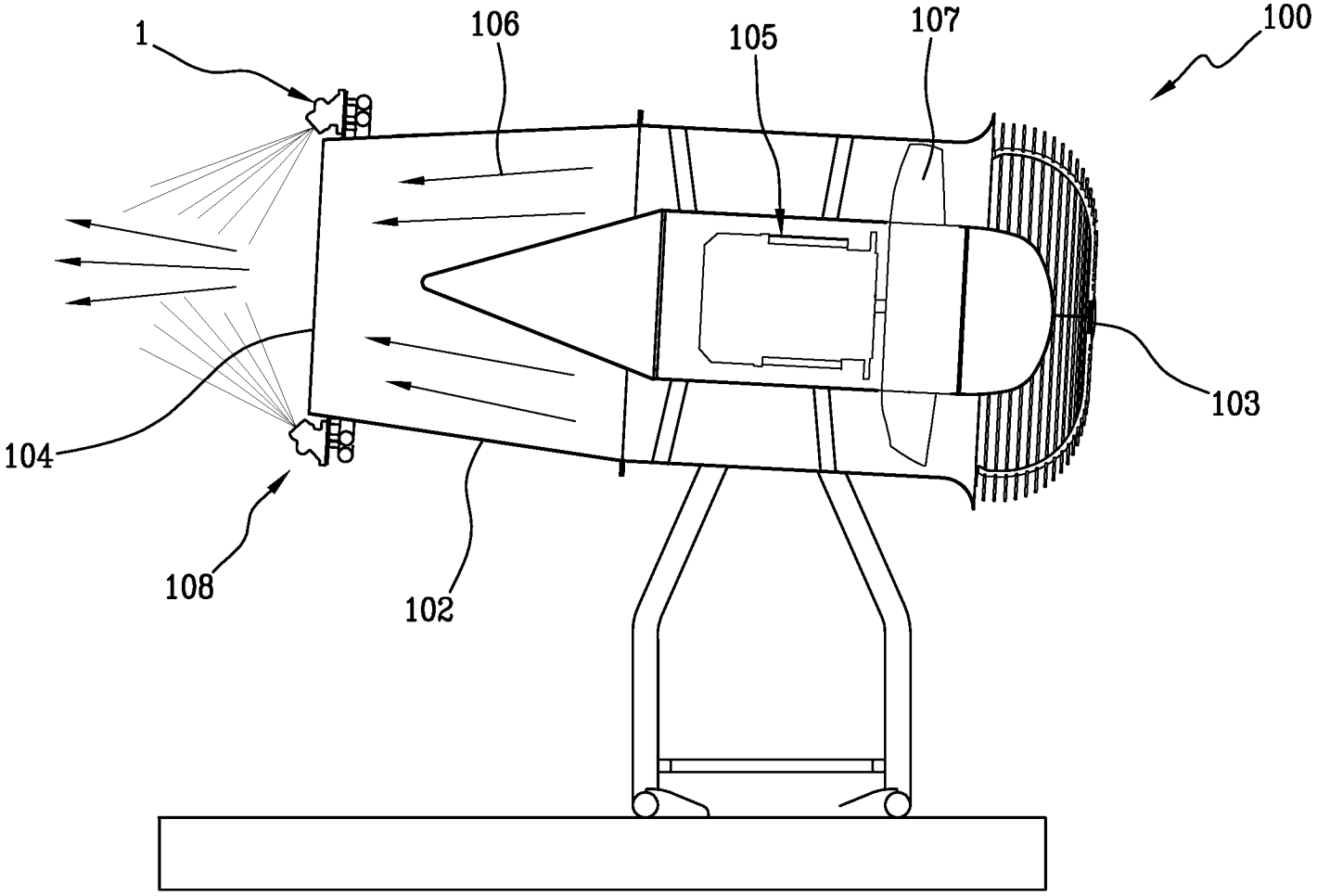

This description will be given below with reference to the attached drawings, provided solely for illustrative and therefore non-limiting purposes, in which:

FIG. 1 shows a lateral cross section of a nucleation nozzle according to the present invention; and FIG. 2 shows a lateral cross section of a device for producing artificial snow.

With reference to the aforementioned figures, the reference number 1 denotes in its entirety a nucleation nozzle for forming freezing nuclei starting from a jet of liquid under pressure.

The present invention is preferably applied on devices 100 for producing artificial snow which can comprise devices called "snow cannons" (as illustrated in FIG. 2) or else devices called "snow lances" (not illustrated).

In particular, a device 100 in the form of a snow cannon comprises a tubular body 102 extending between an air inlet port 103 thereof and an air outlet port 104 thereof. Preferably, the tubular body 102 is a cylindrical body with a circular cross section or an at least partially conical body with a circular cross section.

In addition, the device 100 comprises a blowing means 105 operatively associated with the tubular body 102 so as to generate an air flow 106 along an air flow direction that goes from the inlet port 103 to the outlet port 104.

The blowing means 105 comprises a fan 107 which draws in air from the outside environment and blows it into the tubular body 102 towards the outlet opening 104.

Furthermore, the device 100 comprises a plurality of nebulising nozzles 108 operatively associated with the tubular body 102 so as to spray liquid towards the air flow 106. The nebulising nozzles 108 are preferably positioned around the outlet port 104 and are directed towards the air flow 106. One or more nucleation nozzles 1, preferably up to eight nucleation nozzles 1, are likewise provided at the outlet opening 104.

In particular, the nucleation nozzle 1 comprises a compressed air duct 2 having an inlet opening (not illustrated) and an outlet opening 3. F indicates the compressed air flow defining the flow direction of the compressed air from the inlet opening to the outlet opening 3.

Furthermore, the nucleation nozzle 1 comprises at least one water duct 4 having an inlet opening (not illustrated) and an outlet opening 5. F' indicates the water flow defining the flow direction of the water from the inlet opening to the outlet opening 5.

The outlet opening 5 forms a nozzle (separate from the nebulising nozzles 108 previously described) for nebulising the outlet water so as to nebulise the water to form a plurality of water particles.

The water duct 4 is separate from the compressed air duct 2. In particular, the water duct 4 extends alongside the compressed air duct at least up to the outlet opening 5 of the water duct 4 and the outlet opening 3 of the compressed air duct 2. Preferably, the water duct 4 is positioned around the compressed air duct 2. In this manner, the particles of nebulised water are involved by the accelerated flow of compressed air exiting the opening 3. For this purpose, the outlet opening 5 can be directed toward the air flow exiting the opening 3.

In addition, for each nucleation nozzle 1, there are several water ducts 4. Preferably, per each nucleation nozzle 1, there are several water ducts 4 positioned around the air duct 2.

Furthermore, the outlet opening 5 of the water duct 4 is positioned close to the outlet opening 3 of the compressed air duct 2. Preferably, the outlet opening 5 of the water duct 4 is positioned slightly retracted relative to the outlet opening 3 of the compressed air duct 2 in the flow direction F of the compressed air from the inlet opening to the outlet opening. However, in other embodiments not illustrated in the appended figures, the outlet opening 5 of the water duct 4 could be set in a slightly forward position or flush with the outlet opening 3 of the compressed air duct 2 in the flow direction F of the compressed air.

A first stretch 2*a* of the compressed air duct 2 has a cross section which decreases in the flow direction F. Furthermore, the first stretch 2*a* is followed by a second stretch 2*b* having a cross section which increases in the flow direction F so as to form a convergent-divergent path.

In particular, the inner surface of the compressed air duct 2 is continuous (without steps or interruptions) and curved at least at the passage from first stretch 2*a* to the second stretch 2*b* (preferably the surface is completely continuous) so as to create a continuous guide for the air flow in transit inside the duct 2.

In other words, the two stretches 2*a* and 2*b* together form a nozzle having a constriction, so that the air flow accelerates. In still other words, the two stretches 2*a* and 2*b* together define a one-sheeted hyperboloid shape of the inner surface of the compressed air duct 2.

In the preferred embodiment, the two stretches 2*a* and 2*b* define a Laval nozzle, or more commonly a convergent-divergent nozzle, which enables air to be accelerated up to supersonic speeds.

It should be noted that the incoming compressed air has a value of pressure such as to create, downstream of the narrowing, an acceleration in the air flow to a supersonic level. In detail, the pressure and temperature of the incoming compressed air are set on the basis of the pressure and temperature characteristics of the air outside the nozzle.

For example, the pressure of the incoming air has a higher pressure value than the air downstream of the narrowing.

In particular, the air flow at the smallest cross section of the duct 2 (hence at the narrowing) has a Mach number equal to 1.

Preferably, the pressure of the incoming air flow is such that at the outlet section of the nozzle (downstream of the constriction) the air flow has a Mach number greater than 1 (supersonic acceleration).

Preferably the water duct 4 extends alongside the compressed air duct 2 at least in a stretch close to the respective outlet openings.

Furthermore, the outlet opening 5 of the water duct 4 is facing the outside, like the outlet opening 3 of the compressed air duct 2. In particular, the outlet opening 5 of the water duct 4 is facing the same side of the nucleation nozzle 1 as the outlet opening 3 of the compressed air duct 2.

In particular, the water outlet openings 5 are positioned on the outside relative to the two stretches 2*a* and 2*b* and are not interposed between the two stretches.

As it is illustrated for example in FIG. 1, the nucleation nozzle 1 preferably comprises a plurality of water ducts 4, preferably two or three water ducts, positioned around the compressed air duct 2, which thus represents a central duct.

It should be noted that the nucleation nozzle 1 is defined by a single piece, which the water duct 4 and compressed air duct 2 are hollowed out of.

The present invention further relates to a method for forming freezing nuclei in a device 100 for producing artificial snow. The method derives directly from what has been described above, which is therefore referenced in its entirety.

In, particular, the method comprises supplying compressed air along the compressed air duct 2, thus generating an acceleration by narrowing and widening the cross section of the compressed air duct in the flow direction F of the compressed air from an inlet opening to an outlet opening and supplying water along a water duct 4 separate from the compressed air duct 2 and having an outlet opening 5 positioned close to the outlet opening 3 of the compressed air duct 2. In particular, the inner surface of the compressed air duct 2 is continuous and curved at least at the narrowing so as to create a continuous guide for the air.

The present invention achieves the set objects.

In particular, the present invention enables water to be fragmented so as to obtain particles of a size such as to freeze more rapidly on contact with the outside atmosphere. In fact, as the compressed air is accelerated by means of the Laval effect, the compressed air is greatly slowed outside the nozzle, thus generating a pressure wave that further nebulises the particles of water and makes them even finer. The reduced size of the water particles enables faster freezing with a smaller energy input. In other words, in the outlet area located just after the outlet opening 3 the maximum possible acceleration is reached by the air which involves the particles of nebulised water.

As a further consequence, it is possible to generate a larger amount of snow, which is also of higher quality, i.e. finer. Furthermore, it is possible to generate snow at higher temperatures compared to conventional snow-making devices.

The nucleation nozzle according to the present invention thus enables higher energy efficiency.

As an alternative to what has been described and illustrated, the device for producing artificial snow can define a snow lance comprising at least one nucleation nozzle 1 and one or more nebulising nozzles.

The invention claimed is:

1. A nucleation nozzle for forming freezing nuclei for devices for making artificial snow, wherein the nucleation nozzle comprises:

a compressed air duct having an inlet opening and an outlet opening;

a water duct having an inlet opening and an outlet opening, the outlet opening forming a nozzle for nebulizing water so as to form water particles;

the water duct being separate from the compressed air duct at least at the outlet opening of the water duct so that the water from the water duct and an air flow from the compressed air duct exit separately, wherein the outlet opening of the water duct is positioned close to the outlet opening of the compressed air duct so that the water particles from the outlet opening of the water duct are involved by an air flow from the outlet opening of the compresses air duct;

wherein a first stretch of the compressed air duct has a cross section which decreases in a flow direction of the air flow in the compressed air duct, from the inlet opening to the outlet opening, and wherein the first stretch is followed by a second stretch having a cross section which increases in the flow direction of the air flow in the compressed air duct from the inlet opening to the outlet opening so as to form a convergent-divergent path;

wherein an inner surface of the compressed air duct continuous and curved at least at a passage from the first stretch to the second stretch so as to create a continuous guide for the air flow in transit inside the compressed air duct;

wherein the first stretch and the second stretch together form a nozzle having a constriction, so that the air flow accelerates.

2. The nucleation nozzle according to claim 1, wherein the nucleation nozzle is defined by a single body, and wherein the water duct and the compressed air duct are hollowed out of the single body.

3. The nucleation nozzle according to claim 1, wherein the compressed air duct is a single duct at least in the first stretch and the second stretch.

4. The nucleation nozzle according to claim 1, wherein the first stretch and the second stretch together define a Laval nozzle.

5. The nucleation nozzle according to claim 1, wherein the inner surface of the first stretch and the second stretch together define a hyperboloid shape of the inner surface of the compressed air duct.

6. The nucleation nozzle according to claim 1, further comprising an end portion that includes the outlet opening of the water duct and the outlet opening of the compresses air duct, wherein the water duct extends alongside the compressed air duct at least in the end portion.

7. The nucleation nozzle according to claim 1, further comprising a plurality of water ducts that are positioned around the compressed air duct.

8. The nucleation nozzle according to claim 1, wherein the outlet opening of the water duct is positioned slightly retracted relative to the outlet opening of the compressed air duct in the flow direction of the air flow in the compressed air duct from the inlet opening to the outlet opening.

9. A device for making artificial snow comprising at least one nucleation nozzle according to claim 1, and at least one nebulizing nozzle.

10. The device for making artificial snow according to claim 9 comprising up to eight nucleation nozzles.

11. The device for making artificial snow according to claim 9, defining a snow cannon.

12. The device for making artificial snow according to claim 9, defining a snow lance.

13. A method for forming freezing nuclei in devices for making artificial snow, comprising the following operating steps:

supplying air along a compressed air duct of a nucleation nozzle, the compressed air duct having an inlet opening and an outlet opening;

supplying water along a water duct of the nucleation nozzle, the water duct having an outlet opening forming a nozzle for nebulizing the water to form water particles, wherein the water duct is separate from the compressed air duct at least at the outlet opening of the water duct, wherein the outlet opening of the water duct is positioned close to the outlet opening of the compressed air duct and faces a same outer side of the nucleation nozzle so that the water particles from the outlet opening of the water duct are involved by an air flow from the compressed air duct;

generating an acceleration of the air flow in the compressed air duct by narrowing and widening a cross section of the compressed air duct in flow direction of the compressed air duct, and wherein an inner surface of the compressed air duct is continuous and curved at least in a narrowing and widening stretch so as to form a convergent-divergent path and to create a continuous guide for the air flow in transit inside the compressed air duct from the inlet opening to the outlet opening of the compressed air duct so that the air flow in the compressed air duct accelerates.

* * * * *